US011180983B2

(12) United States Patent
Scogin et al.

(10) Patent No.: US 11,180,983 B2
(45) Date of Patent: Nov. 23, 2021

(54) DISTRIBUTED SENSOR SYSTEMS AND METHODS

(71) Applicant: Halliburton Energy Services, Inc., Houston, TX (US)

(72) Inventors: Matthew Scogin, Magnolia, TX (US); James Flygare, Humble, TX (US); Colin McKay, Houston, TX (US); Aswin Balasubramanian, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 137 days.

(21) Appl. No.: 15/539,520

(22) PCT Filed: Apr. 28, 2016

(86) PCT No.: PCT/US2016/029871
§ 371 (c)(1),
(2) Date: Jun. 23, 2017

(87) PCT Pub. No.: WO2017/188964
PCT Pub. Date: Nov. 2, 2017

(65) Prior Publication Data

US 2018/0266236 A1 Sep. 20, 2018

(51) Int. Cl.
*E21B 47/12* (2012.01)
*E21B 47/017* (2012.01)
(Continued)

(52) U.S. Cl.
CPC ..... *E21B 47/017* (2020.05); *E21B 17/003* (2013.01); *E21B 47/01* (2013.01); *E21B 47/07* (2020.05); *E21B 47/12* (2013.01)

(58) Field of Classification Search
CPC combination set(s) only.
See application file for complete search history.

(56) References Cited

U.S. PATENT DOCUMENTS 4,862,428 A 8/1989 Jackett et al.
5,172,717 A * 12/1992 Boyle ..... E21B 34/06 137/155
(Continued)

FOREIGN PATENT DOCUMENTS

KR 20120090616 A 8/2012
WO 03083248 10/2003
(Continued)

OTHER PUBLICATIONS

International Search Report and Written Opinion of PCT Application No. PCT/US2016/029871 dated Jan. 24, 2017: pp. 1-15.

*Primary Examiner* — Cathleen R Hutchins
*Assistant Examiner* — Ronald R Runyan
(74) *Attorney, Agent, or Firm* — Chamberlain Hrdlicka

(57) ABSTRACT

A distributed downhole sensor system for a well includes a sensor array comprising. The sensor array includes a plurality of sensors and cable segments. Each sensor is associated with a unique digital address and locatable downhole to capture sensor data simultaneously and output the simultaneously captured sensor data under a first control condition, and a single sensor of the plurality of sensors is configured to capture sensor data independently and output the independently captured sensor data under a second control condition. The cable segments couple the sensors in a line or an array to deliver power to the sensors and provide a communication channel to and from the sensors.

17 Claims, 4 Drawing Sheets

(51) Int. Cl.

| | |
|---|---|
| ***E21B 17/00*** | (2006.01) |
| ***E21B 47/01*** | (2012.01) |
| ***E21B 47/07*** | (2012.01) |

(56) References Cited

U.S. PATENT DOCUMENTS

| | | | | |
|---|---|---|---|---|
| 5,662,165 | A * | 9/1997 | Tubel | E21B 23/03 166/250.01 |
| 6,279,392 | B1 * | 8/2001 | Shahin, Jr. | C09K 8/42 166/250.14 |
| 6,480,000 | B1 | 11/2002 | Kong et al. | |
| 6,511,478 | B1 * | 1/2003 | Burnside | A61B 18/1492 600/549 |
| 8,055,730 | B2 * | 11/2011 | Brady | G01V 1/22 702/14 |
| 8,146,658 | B2 | 4/2012 | Howard et al. | |
| 8,757,276 | B2 | 6/2014 | Alff et al. | |
| 2004/0040707 | A1 * | 3/2004 | Dusterhoft | E21B 17/206 166/279 |
| 2004/0216872 | A1 | 11/2004 | Foster et al. | |
| 2005/0194182 | A1 | 9/2005 | Rodney et al. | |
| 2005/0194184 | A1 * | 9/2005 | Gleitman | E21B 17/028 175/45 |
| 2007/0007005 | A1 * | 1/2007 | Heller | E21B 43/02 166/250.01 |
| 2008/0224887 | A1 | 9/2008 | Varsamis et al. | |
| 2011/0208362 | A1 * | 8/2011 | Alstrin | G05D 7/0635 700/282 |
| 2012/0013481 | A1 | 1/2012 | Clark | |
| 2012/0179378 | A1 | 7/2012 | Duncan | |
| 2012/0273186 | A1 | 11/2012 | Ramakrishnan et al. | |
| 2012/0312102 | A1 * | 12/2012 | Alvarez | F16J 15/3296 73/862.041 |
| 2013/0099791 | A1 * | 4/2013 | Tse | G01V 1/52 324/347 |
| 2013/0120154 | A1 | 5/2013 | Gleitman | |

FOREIGN PATENT DOCUMENTS

| | | |
|---|---|---|
| WO | 2010068463 | 6/2010 |
| WO | 2016040140 | 3/2016 |

* cited by examiner

DISTRIBUTED SENSOR SYSTEMS AND METHODS

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

Oil and gas wells are typically instrumented with various sensors downhole to measure various conditions of the downhole environment and/or well parameters such as temperature, pressure, vibration, cable fault, position and orientation, flow, density, among others. As wells may be very deep, such as 3,000 feet to 10,000 feet or more, the conditions may be different at different depth of the well. Thus, in order to gather data regarding conditions throughout the depth of the well, sensors need to be placed at different depths throughout the well. However, the downhole environment and its lack of easy accessibility present many challenges for instrumenting the well.

Additionally, instrumenting the well with sensors may add additional time to the well completions process, increasing cost.

BRIEF DESCRIPTION OF THE DRAWINGS

For a detailed description of the embodiments of the invention, reference will now be made to the accompanying drawings in which.

DETAILED DESCRIPTION

Figure 1:
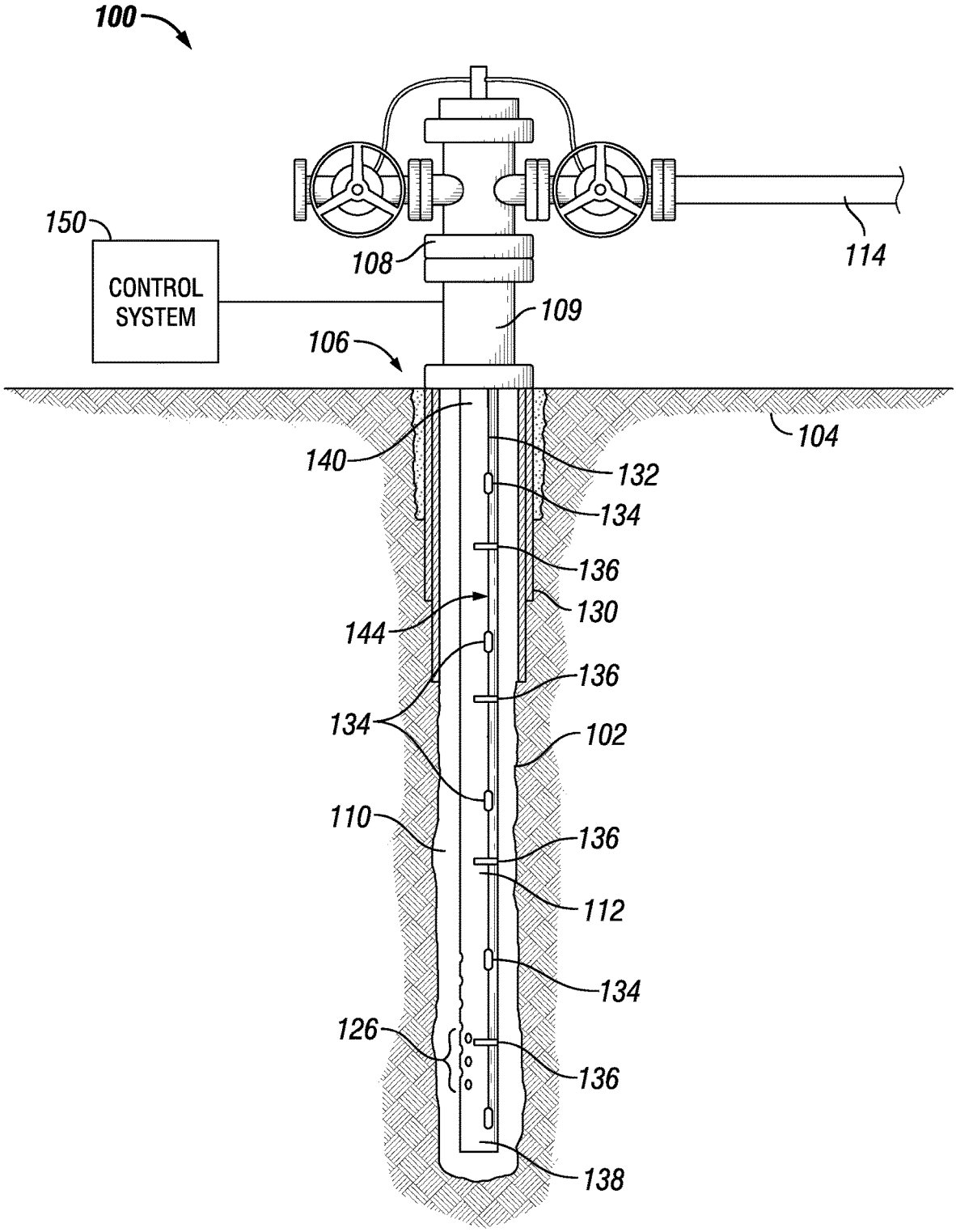
FIG. 1 is a schematic view illustrating a production well instrumented with a multi-point sensor line, in accordance with some embodiments.

Referring now to the figures, FIG. 1 illustrates an example production well system 100. The well system 100 includes a well 102 formed within a formation 104. The well 102 may be a vertical wellbore as illustrated or it may be a horizontal or directional well. The formation 104 may be made up of several zones which may include oil reservoirs. In certain example embodiments, the well system 100 may include a production tree 108 and a wellhead 109 located at a well site 106. A production tubing 112 extends from the wellhead 109 into the well 102. The production tubing 112 includes a plurality of perforations 126 through which fluids from the formation 104 can enter the production tubing 112 and flow upward into the production tree 108.

In some embodiments, the wellbore 102 is cased with one or more casing segments 130. The casing segments 130 help maintain the structure of the well 102 and prevent the well 102 from collapsing in on itself. In some embodiments, a portion of the well is not cased and may be referred to as "open hole." The space between the production tubing 112 and the casing 130 or wellbore 102 is an annulus 110. Production fluids enter the annulus 110 from the formation 104 and then enter the production tubing 112 from the annulus 110. Production fluid enters the production tree 108 from the production tubing 112. The production fluid is then delivered to various surface facilities for processing via a surface pipeline 114.

It should be appreciated that well system 100 is only an example well system and there are many other well system configurations which may also be appropriate for use.

A multi-point sensor line 144 is disposed downhole in the wellbore 102. In some embodiments, the sensor line 144 is disposed on the outside of the production tubing 112 along at least a portion of the length of the production tubing 112. In some embodiments, the sensor line 144 is coupled to the production tubing 112 with a plurality of clamps 136 at intervals along the sensor line 144. The sensor line 144 includes a cable 132 with a plurality of sensors. The sensors 134 are configured to take measurements of one or more downhole conditions such as temperature, pressure, moisture, vibration, position and orientation in well, and the like. Accordingly, the sensors 134 may be a temperature sensor, a pressure sensor, a moisture sensor, an accelerometer, and the like. In some embodiments, the sensors 134 may all be temperature sensors, all pressure sensors, or all another type of sensor. In other embodiments, the sensor line 144 includes a mix of different types of sensors. The sensor line 144 may be coupled to an above-surface control system 150 that supplies power to the sensors 134 and receives the data from the sensors 134. The sensor line 144 may reach a lower end 138 of the production tubing 138 or any point between the upper end 140 and the lower end 138. In some embodiments, the sensors 134 are distributed along the length of the production tubing 112 such that one sensor 134 is uphole of another. Thus, the sensors 134 can take measurements at various depths of the well 102.

Figure 2:
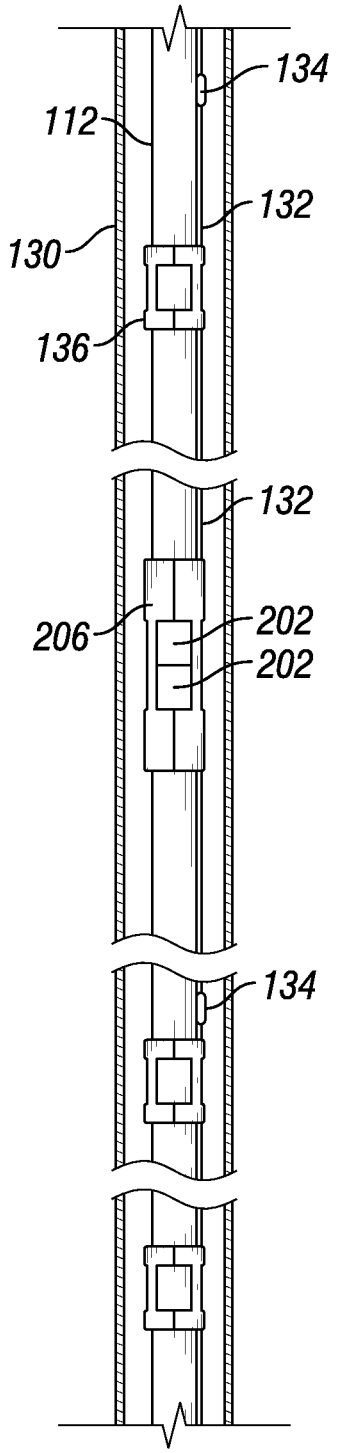
FIG. 2 is a schematic view illustrating a production tubing with a multi-point sensor line attached thereto, in accordance with some embodiments.

FIG. 2 is a detailed view of the production tubing 112 with the sensor line 144 coupled thereto. The sensor line 144 is coupled against the outer surface of the production tubing 112 with clamps 136 or other detainment devices. In some embodiments, the production tubing 112 is made up of a plurality of pipe segments coupled together at the ends 202. The sensor line 144 extends across the joined ends 202 and is coupled by an end clamp 206 which extends across the joined ends 202 of the pipe segments. In some implementations, the production tubing 112 may be instrumented with more than one sensor line 144 or a sensor network.

Figure 3:
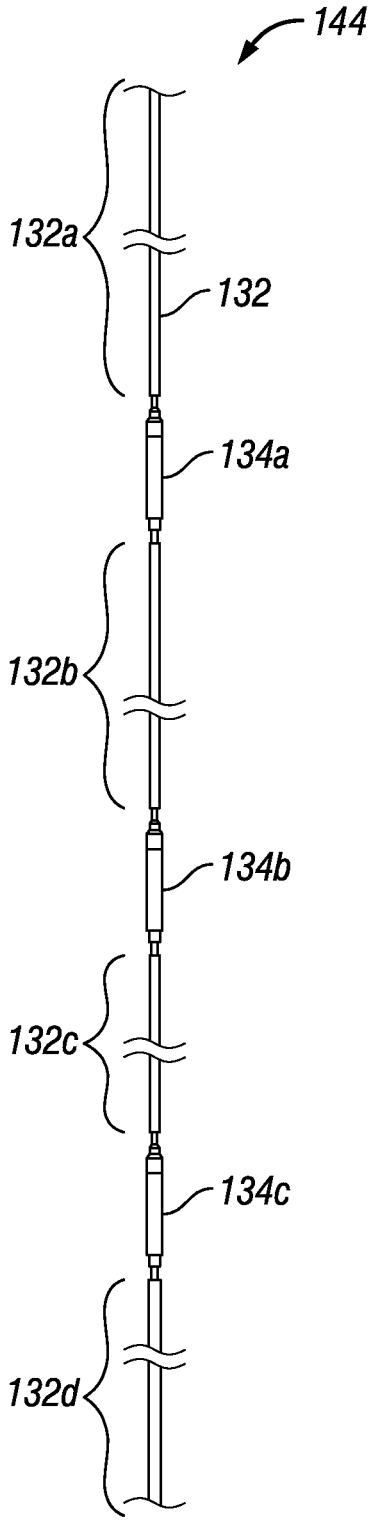
FIG. 3 is a detailed view illustrating the sensor line of the multi-point sensor line, in accordance with some embodiments.

FIG. 3 illustrates the sensor line 144 by itself. The sensor line 144 includes a plurality of cable segments 132*a*, 132*b*, 132*c*, 132*d* and a plurality of sensors 134*a*, 134*b*, 134*c*. In some embodiments, the cable segments 132 and the sensors 134 are coupled linearly and alternatingly. The sensors 134 may be welded to the cable segments 132. The cable 132 may be tubing encapsulated cable or any other type of insulated cable suitable for this application as will be known to one skilled in the art. The number of and distance between the sensors 134*a*, 134*b*, 134*c* can vary depending on the application and desired resolution of the well data. The sensor line 144 can have any appropriate overall length, such as 3,000 feet, 10,000 feet, etc., depending on the application and the well 102. In some embodiments, the connections between the sensors 134*a*, 134*b*, 134*c* and the cable segments 132*a*, 132*b*, 132*c*, 132*d* may be encased or wrapped with shrink tubing or other means of mechanism reinforcement.

Figure 4:
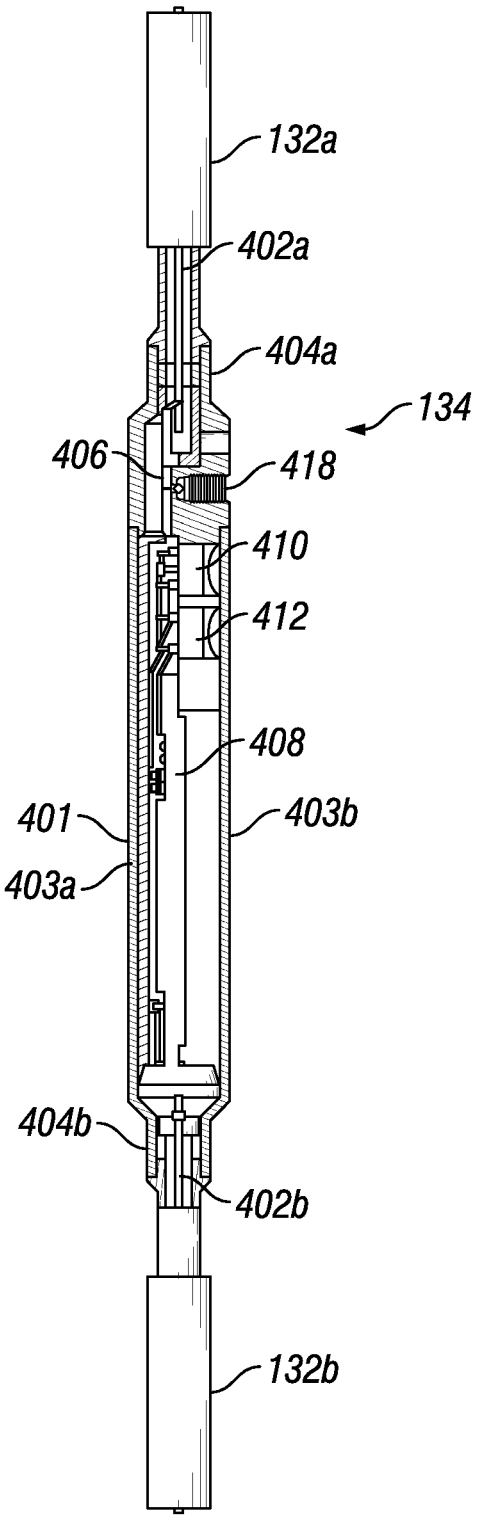
FIG. 4 is an internal view illustrating a sensor of the multi-point sensor line, in accordance with some embodiments.

FIG. 4 is an internal view of a sensor 134 of the sensor line 144. The sensor 134 includes a housing 401 including a first end 404*a* and a second end 404*b*. In some embodiments the housing 401 is made up of a first housing portion 403*a* and a second housing portion 403*b* coupled together by a screw 418. The housing 401 contains the sensor components and electronics that enable the functions of the sensor 134. The housing 401 of the illustrated embodiment has a tubular shape, but in other embodiments the housing 401 may have other shapes containing an orifice in which sensor components can be disposed. The housing 401 may be fabricated from metals or metal alloys, or from any other suitable material as will be known to one skilled in the art. In some embodiments, housing 401 may be designed to withstand certain pressure, such as 30,000 psi. The housing 401 higher or lower pressure ratings than 30,000 psi.

The sensor 134 is coupled to a first cable segment 132*a* at the first end 404*a* and to the second cable segment 132*b* at the second end 404*b*. Each of the first and second cable segments 132*a*, 132*b* includes a conductor 402*a*, 402*b*.The conductor 402*a*, 402*b* may be a copper conductor or any other suitable type of conductor. The cable segments 132*a*, 132*b* may also have a filler material disposed therein that centralizes the conductors 134*a*, 134*b*. In some embodiments, the first end 404*a* of the sensor housing 401 is coupled to the first cable segment 132. Specifically, the first end 404*a* of the sensor housing 401 may be welded, soldered, or otherwise mechanically coupled to the first cable segment 132. The second end 404*b* of the sensor housing 401 may be likewise coupled to the second cable segment 132*b*. When the sensor 134 is coupled to the cable segments 132, the conductors 402 of the cable segments 132 may extend partially into the sensor housing 401. In some embodiments, instead of or in addition to welding the sensor 134 to the conductors 402, the sensors 134 may be coupled to the conductors 402 through metal-to-metal seals or elastomeric seals.

In some embodiments, the sensor 134 includes a conductive path 406 disposed therein. The conductive path 406 is electrically coupled to the conductor 402*a* of the first cable segment 132*a* at one end and to the conductor 402*b* of the second cable segment 132 at another end. Thus, the conductor 402*a* of the first cable segment 132*a* is electrically coupled to the conductor 402*b* of the second cable segment 132*b*. The conductive path 406 may be a wire wrapped around, solder, crimped, and/or potted to the conductors 402 at the ends. In other embodiments, the conductive path 406 may be implemented as a trace on a circuit board or as a piece of conductive material. To which the conductors 402 are soldered or otherwise electrically coupled. In some embodiments, there may additionally be a pressure seal disposed between the cable segments 132 and the ends 404 of the sensor housing 401. The pressure seal provides a barrier, preventing wellbore fluids from entering the sensor 134 and cable segments 132.

In the embodiment illustrated in FIG. 4, the sensor 134 is a temperature sensor that includes one or more application specific integrated circuits (ASIC). The ASICs may be housed in a multi-chip-module (MCM) 408. The sensor 134 may further include a reference crystal 410, and a temperature crystal 412. The crystals 410, 412 may be quartz crystals. The MCM 408 may include multiple ASICs or integrated circuit connected on a single substrate. The MCM 408 may also hermetically sealed and use a ceramic substrate. The MCM 408 enables telemetry and power conversions for sensor 134. The ASIC 408 is electrically coupled to the internal conductor 406 and draws power therefrom, powering the ASIC 408 and other electrical components of the sensor 134.

The ASIC 408 is coupled to the reference crystal 410 and the temperature crystal 412. The ASIC 408 calibrates and drives the crystals 410, 412 as well as detects their oscillation frequency. The ASIC 408 may perform some processing on the measured frequency to generate a temperature data that can be sent uphole to the control system 150 via the cable 132. In some embodiments, each sensor 134 in the sensor line 144 may have a unique address. In certain such embodiments, the control system 150 may send a request to one of the sensors 134 requesting a data output. The request contains the address of the requested sensor 134 and only the requested sensor 134 responds with the data. Thus, the control system 150 is able to map received data to the sending sensor 134. The control system 150 may successively poll all of the sensors in this fashion. In some embodiments, the sensors 134 are configured to send data to the control system 150 via the cable 132 automatically without receiving a specific request from the control system 150. In such embodiments, each sensor 134 may encode their unique address or identifier into the data. Thus, when the control system 150 receives the data from all of the sensors 134, it can parse and/or map each individual data packet to the sending sensor 134. The ASIC 408 may perform analog as well as digital signal processing. In some embodiments, a chassis for the ASIC 408 is integrated with the housing 401. In some cases, all sensors 134 can be configured to take data measurements at the same instance of time using a synchronization scheme. This can be followed by the data being automatically pushed or sensors 134 being addressed individually for data retrieval.

The ASICs or MCM 408 is an example means for carrying out the processing and other electronic functions of the sensor 134. However, other types and combinations of electronic components and circuit designs can be used to carry out similar functions. Thus the use of ASICs is an enabling example and not a limitation of the present disclosure.

In some embodiments, the conductive path 406 electrically coupling the first and second cable segments 132*a*, 132*b* does not depend on the functionality of the ASIC 408 or any other electronic component in the sensor 134. If the circuitry of the sensor 134 fails and the sensor 134 does not return data, as long as the conductive path 406 is not impeded, power can be delivered through the sensor and to the other sensors 134 in the sensor line 144. In other words, the electronics of the sensor 134 draws power from the conductive path 406 in a parallel manner rather than in a series manner. Thus, the remaining sensors 134 in the sensor line may remain functional if one sensor 134 in the sensor line fails. In some embodiments, the sensors 134 includes a temporary or permanent strain relieving mechanism on top and bottom of each sensor 134 to protect the sensor line 144, particularly during deployment and retrieval of the sensor line 144.

Figure 5:
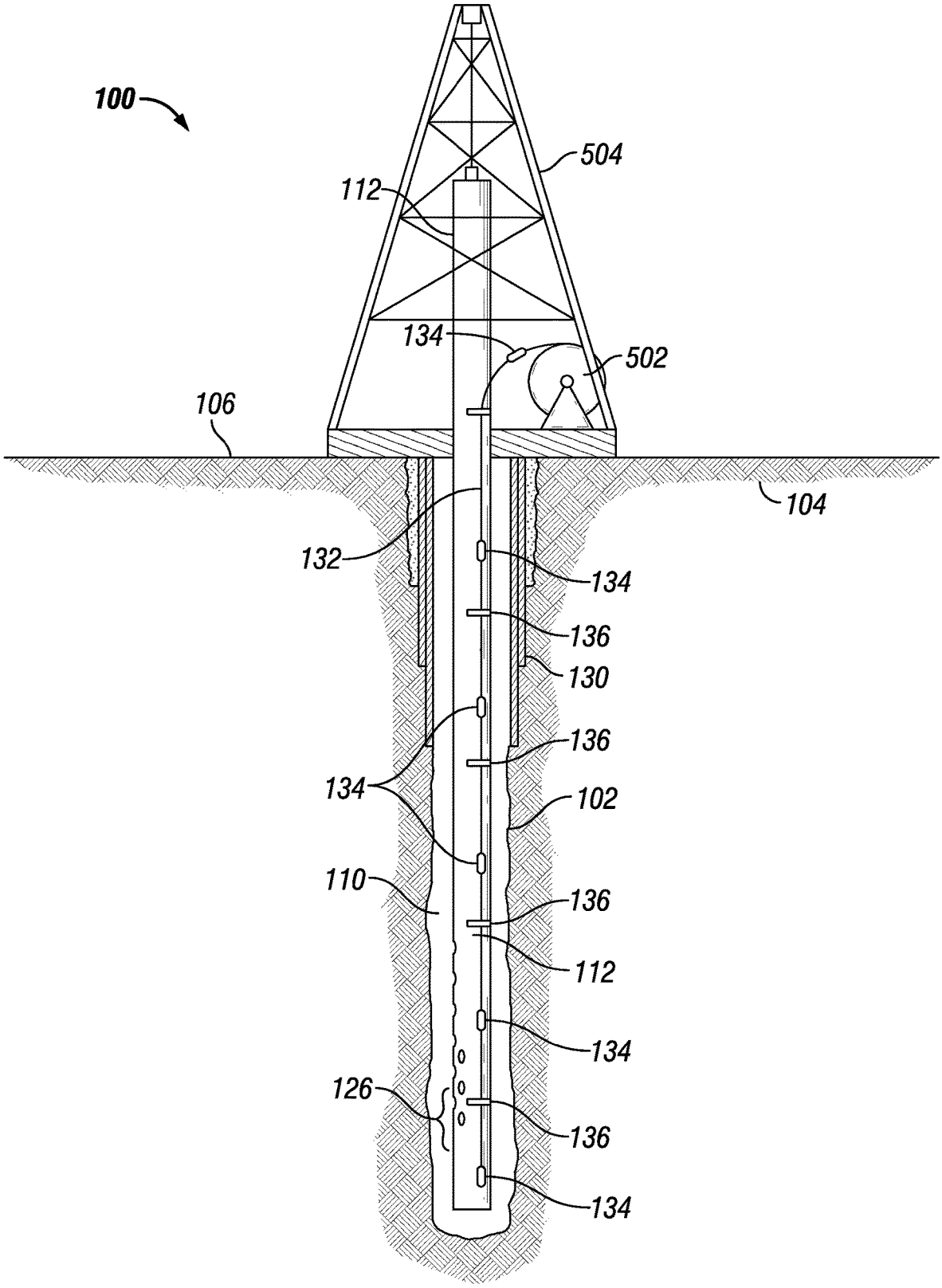
FIG. 5 is a schematic view illustrating deployment of the multi-point sensor line, in accordance with some embodiments.

The sensor line 144 is substantially fabricated previous to deployment downhole. In some embodiments, the sensor line 144 may be wrapped around a spool, wherein it is stowed until coupled to the production tubing 112 and deployed downhole. FIG. 5 is a schematic view of a run in hole (RIH) operation in which a multi-point sensor line 144 is being deployed. A RIH operation is performed to land a production tubing 112 into the well 102, through which production fluids are brought uphole from the well and delivered to surface facilities. The RIH operation is generally performed after the well is drilled and cased. The production tubing 112 is generally made up of a plurality of pipe segments coupled together to form the production tubing 112. During the RIH operation, one pipe segment is lowered partially into the well and suspended at one end at the surface. Another pipe segment is lifted above the first pipe segment from a rig 504 and coupled to the first pipe segment, forming a pipe string. The pipe string is then lowered further into the well 102. Additional pipe segments are added to the pipe string in this manner until the desired depth is reached.

The prefabricated sensor line 144 is coupled to the production tubing 112 as the production tubing 112 is being put together and lowered into the well 102. Specifically, in some embodiments, the sensor line 144 is coupled to the pipe string at one or more points above ground. When the tubing string is lowered, the sensor line 144 is lowered into the well as well. In some embodiments, the sensor line 144 is unspooled from a spool 502 as it is lowered downhole. The sensor line 144 is continuously unspooled and coupled to the pipe string and lowered downhole. In some embodiments, the sensor line 144 is coupled to the production tubing 112 via clamps or other coupling means. The sensor line 144 may be clamped to the production tubing 112 at various intervals, such as 30 feet. In some embodiments, the sensor line 144 may also be joined to pup joints in addition to the production tubing 112.

Once the production tubing 112 is installed in the well, the sensor line 144 is coupled to an above-ground control system 150. The sensor line 144 can then be powered and operated. As the sensor line 144 is prefabricated prior to deployment downhole, the process of deploying the sensor line 144 (e.g., coupling the sensor line 144 to the production tubing 112), does not add significant time to the RIH operation.

In addition to the embodiments described above, many examples of specific combinations are within the scope of the disclosure, some of which are detailed below:

Example 1

A distributed downhole sensor system for a well, comprising:

a sensor array comprising:

a plurality of sensors, wherein each sensor is associated with a unique digital address and locatable downhole to capture sensor data simultaneously and output the simultaneously captured sensor data under a first control condition, and wherein a single sensor of the plurality of sensors is configured to capture sensor data independently and output the independently captured sensor data under a second control condition; and cable segments coupling the sensors in a line or an array to deliver power to the sensors and provide a communication channel to and from the sensors.

Example 2

The system of example 1, further comprising a control device coupled to the sensor array to power the sensors and receive data from the sensors.

Example 3

The system of example 1, wherein a failure of one of the sensors does not affect the functionality of any other sensor.

Example 4

The system of example 1, wherein the sensors are configured to draw power from the cable segments in an electrically parallel manner.

Example 5

The system of example 4, wherein each sensor comprises a conductor to electrically couple the sensor to the cable segments.

Example 6

The system of example 1, wherein the plurality of sensors comprises temperature sensors, pressure sensors, or both.

Example 7

The system of example 1 or 6, wherein the plurality of sensors comprises one or more quartz based sensor.

Example 8

The system of example 1, wherein the first control condition comprises a request for simultaneously captured sensor data from the sensors, and wherein the second control condition comprises a request for sensor data from a single sensor.

Example 9

The system of example 1, wherein the sensors comprise strain relieving mechanisms.

Example 10

A method of deploying a distributed sensor system downhole in a well, comprising:

providing a prefabricated sensor array, the prefabricated sensor array comprising a plurality of sensors coupled together via cable segments;

coupling the prefabricated sensor line to a production tubing;

lowering the production tubing into the well; and lowering the production tubing further into the well, wherein the second portion of the prefabricated sensor line is uphole of the first portion of the prefabricated sensor line.

Example 11

The method of example 10, further comprising:

coupling the prefabricated sensor line to a control system; and providing power to the plurality of sensors from the control system.

Example 12

The method of example 10, wherein the failure of one of the plurality of sensors does not affect the functionality of any other sensor in the plurality of sensors.

Example 13

The method of example 10, wherein the plurality of sensors comprises a temperature sensor, a pressure sensor, or both.

Example 14

The method of example 10 or 13, wherein the plurality of sensors comprises one or more quartz based sensor.

Example 15

A method of operating a distributed sensor system, comprising:

simultaneously capturing sensor data with a plurality of sensors in a sensor array under a first control condition, wherein the plurality of sensors are disposed at various depths downhole and coupled together via cable segments;

transmitting the simultaneously captured sensor data uphole via the cable segments under the first control condition;

independently capturing sensor data with a single sensor in the sensor array under a second control condition; and transmitting the independently captured sensor data uphole via the cable segments under the second control condition.

Example 16

The method of example 15, wherein each sensor is associated with a unique digital address.

Example 17

The method of example 16, wherein the first control condition comprises receiving a request for simultaneous sensor data from the plurality of sensors; and wherein the second control condition comprises receiving a request for an independent sensor data from the single sensor.

Example 18

The method of example 16, wherein the sensor data comprises temperature data, pressure data, or both.

Example 19

The method of example 16, wherein the first control condition comprises preprogrammed instructions to output simultaneous sensor data from the plurality of sensors; and wherein the second control condition comprises preprogrammed instructions to output an independent sensor data from the single sensor.

Example 20

The method of example 17, wherein the plurality of sensors includes one or more quartz based sensor.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A distributed downhole sensor system for sensing along a production tubing in a well, comprising a prefabricated sensor line comprising:

a sensor array configured to be attachable along the production tubing and comprising a plurality of sensors, wherein each sensor is associated with a unique digital address and locatable downhole and responds to a first control condition comprising a first request to noncontinuously capture sensor data at a same specified instance of time as the other sensors using a synchronization scheme and output the captured sensor data and unique digital address, and wherein, in addition to responding to first control condition, a single sensor of the plurality of sensors also responds to a second control condition that is different from the first control condition and comprising a second request to capture sensor data independently of the other sensors and of the synchronization scheme and output the independently captured sensor data; and cable segments coupling the sensors to deliver power to the sensors and provide a communication channel to and from the sensors.

2. The system of claim 1, further comprising a control device coupled to the sensor array to power the sensors and receive data from the sensors.

3. The system of claim 1, wherein a failure of one of the sensors does not affect the functionality of any other sensor.

4. The system of claim 1, wherein the sensors are configured to draw power from the cable segments in an electrically parallel manner.

5. The system of claim 4, wherein each sensor comprises a conductor to electrically couple the sensor to the cable segments.

6. The system of claim 1, wherein the plurality of sensors comprises temperature sensors, pressure sensors, or both.

7. The system of claim 1, wherein the plurality of sensors comprises one or more quartz based sensor.

8. The system of claim 1, wherein the sensors comprise strain relieving mechanisms.

9. A method of deploying a distributed sensor system downhole in a well, comprising:

providing a prefabricated sensor line, the prefabricated sensor line comprising a sensor array comprising a plurality of sensors coupled together via cable segments, wherein each sensor is associated with a unique digital address and locatable downhole and responds to a first control condition comprising a first request to noncontinuously capture sensor data at a same specified instance of time as the other sensors using a synchronization scheme and output the captured sensor data and unique digital address and wherein, in addition to responding to first control condition, a single sensor of the plurality of sensors also responds to a second control condition that is different from the first control condition and comprising a second request to capture sensor data independently of the other sensors and of the synchronization scheme and output the independently captured sensor data;

coupling the prefabricated sensor line to a first production tubing;

lowering the first production tubing into the well;

coupling the prefabricated sensor line to a second production tubing;

coupling the second production tubing to the first production tubing; and lowering the second production tubing into the well.

10. The method of claim 9, further comprising:

coupling the prefabricated sensor line to a control system; and providing power to the plurality of sensors from the control system.

11. The method of claim 9, wherein the failure of one of the plurality of sensors does not affect the functionality of any other sensor in the plurality of sensors.

12. The method of claim 9, wherein the plurality of sensors comprises a temperature sensor, a pressure sensor, or both.

13. The method of claim 9, wherein the plurality of sensors comprises one or more quartz based sensors.

14. A method of operating a distributed sensor system distributed along a production tubing in a wellbore, comprising:

operating control system to control a plurality of sensors in a sensor array under a first control condition comprising a first request to noncontinuously capture sensor data at a same specified instance in time using a synchronization scheme, wherein the plurality of sensors are disposed at various depths in the wellbore and coupled together via cable segments, and each sensor of the plurality of sensors is associated with a unique digital address;

transmitting the captured sensor data and unique digital addresses uphole via the cable segments under the first control condition;

operating the control system to control a single sensor in the sensor array under a second control condition that is different from the first control condition and comprising a second request to capture sensor data independently of the other sensors and of the synchronization scheme; and transmitting the independently captured sensor data uphole via the cable segments under the second control condition.

15. The method of claim 14, wherein the sensor data comprises temperature data, pressure data, or both.

16. The method of claim 14, wherein:

the first control condition comprises preprogrammed instructions to output the captured sensor data and unique digital addresses from the plurality of sensors at the same specified instance in time using the synchronization scheme; and the second control condition comprises preprogrammed instructions to output the independently captured sensor data from the single sensor.

17. The method of claim 14, wherein the plurality of sensors includes one or more quartz based sensors.

* * * * *